US006448214B1

(12) United States Patent
Del Duca et al.

(10) Patent No.: US 6,448,214 B1
(45) Date of Patent: Sep. 10, 2002

(54) LIQUID AQUEOUS BLEACHING COMPOSITIONS

(75) Inventors: Valerio Del Duca, Massalubrense; Carlo Ricci; Roberto Scaramella, both of Rome, all of (IT)

(73) Assignee: The Proctor & Gamble Company, Cincinnatti, OH (US)

( * ) Notice: Subject to any disclaimer, the term of this patent is extended or adjusted under 35 U.S.C. 154(b) by 0 days.

(21) Appl. No.: 09/509,914

(22) PCT Filed: Oct. 7, 1998

(86) PCT No.: PCT/US98/21298

§ 371 (c)(1),
(2), (4) Date: Aug. 29, 2000

(87) PCT Pub. No.: WO99/18183

PCT Pub. Date: Apr. 15, 1999

(30) Foreign Application Priority Data

Oct. 8, 1997 (EP) ..... 97870152

(51) Int. Cl.[7] ..... C11D 3/395; C11D 7/54; C11D 17/00; C11D 17/08

(52) U.S. Cl. ..... 510/372; 510/375; 510/422

(58) Field of Search ..... 510/372, 375, 510/405, 421, 422

(56) References Cited

U.S. PATENT DOCUMENTS 4,830,782 A 5/1989 Broze et al. ..... 252/545

FOREIGN PATENT DOCUMENTS

| | | | |
|---|---|---|---|
| EP | 624640 | 11/1994 | ..... C11D/3/39 |
| EP | 843001 | 5/1998 | ..... C11D/3/39 |
| EP | 856577 | 8/1998 | ..... C11D/1/94 |

OTHER PUBLICATIONS

XP002095375 Abstract, Derwent Publications Ltd., London, GB, Apr. 15, 1997.
XP002095376 Abstract, Derwent Publications Ltd., London, GB Feb. 18, 1997.

*Primary Examiner*—Yogendra N. Gupta
*Assistant Examiner*—John M. Petruncio
(74) *Attorney, Agent, or Firm*—Richard S. Echler, Sr.; James F. McBride; Kim W. Zerby

(57) ABSTRACT

The present invention relates to a low viscosity, aqueous liquid composition suitable for bleaching and pretreating soiled fabrics. Such composition contains a peroxygen bleach, an ethoxylated nonionic surfactant, a zwitterionic betaine surfactant and a viscosity reducing agent. In addition to improved cleaning performance, such composition provides satisfactory fabric and color safety when used as a laundry pretreater.

19 Claims, No Drawings

LIQUID AQUEOUS BLEACHING COMPOSITIONS

TECHNICAL FIELD

The present invention relates to bleaching compositions particularly suitable for the pretreatment of fabrics.

BACKGROUND OF THE INVENTION

Peroxygen bleach-containing compositions typically based on hydrogen peroxide have been extensively described in laundry applications as laundry detergents, laundry additives or laundry pretreaters.

Indeed, it is known to use liquid aqueous bleaching compositions comprising hydrogen peroxide in laundry pretreatment applications. Although, these liquid aqueous bleaching compositions provide some bleaching performance when used to pretreat a soiled fabric, there is still some room for further improvement regarding the stains removal performance on various stains including for example greasy stains as well as for further improvement on bleaching performance in pretreatment conditions, i.e. when the liquid aqueous composition is applied neat on the fabric to bleach before the fabric is subsequently rinsed or washed then rinsed with water.

Also such liquid aqueous compositions for laundry pretreatment application should have water-like behaviour (low viscosity) for appropriate usage.

It is know that stain removal performance of liquid aqueous peroxygen bleach-containing compositions may be improved by the additions of surfactants. However, a problem encountered with the use of surfactant systems in liquid aqueous peroxygen bleach-containing compositions is that while providing effective stain removal performance to the fabrics pretreated therewith, high viscosity is also delivered to these compositions.

Accordingly, the formulator of bleaching compositions suitable for laundry pretreatment is faced with the challenge of formulating a liquid aqueous bleaching composition which exhibits effective stain removal performance and bleaching performance as well as low viscosity. Thus, it is an object of the present invention to provide a liquid aqueous composition providing effective bleaching performance and effective stain removal performance under laundry pretreatment conditions, while exhibiting low-viscosity properties.

It has now been found that this object can be efficiently met by formulating a liquid aqueous composition comprising a peroxygen bleach, an ethoxylated nonionic surfactant (0.001%–30%), a zwitterionic betaine surfactant (0.001%–20%) and a viscosity controlling agent selected from the group consisting of C3–C6 alkyl ammonium salt, solvents, i.e., glycols as defined herein, C3–C8 alcohols, and/or aromatic alcohols as defined herein, and mixtures thereof.

It has now been found that such compositions when used to pretreat fabrics boosts the removal of various types of stains including greasy stains and/or enzymatic stains and more surprisingly the bleaching performance as compared to the stain removal and bleaching performance delivered by the same compositions comprising only one of these surfactants (i.e., ethoxylated nonionic surfactant or zwitterionic betaine surfactant) at equal total level of surfactant while delivering low viscosity. Indeed, it has been found that the addition of such a viscosity controlling agent allows to decrease the viscosity of a liquid aqueous peroxygen bleach-containing composition comprising an ethoxylated nonionic surfactant and a zwitterionic betaine surfactant without compromising on the stain removal performance and bleaching performance of the composition. In other words, it is by combining these ingredients that a liquid aqueous composition particularly suitable for pretreating fabrics, can be provided that combines optimum stain removal and bleaching performance as well as optimum viscosity characteristics.

Advantageously, the compositions of the present invention exhibit effective stain removal performance on stains like kitchen soils comprising mainly edible oils, bathroom soils comprising mainly sebum and/or soap scum, floor soils comprising mainly particulate soils and more generally on any greasy stains (e.g., olive oil, mayonnaise, vegetal oil, make up like lipstick), enzymatic stains (grass, blood) as well as bleachable stains (e.g., tea, coffee).

Advantageously, they also provide satisfactory fabric and colour safety when used as laundry pretreaters.

It has further surprisingly been found that the addition of C3–C6 alkyl ammonium salt and/or solvent as defined herein, in a liquid aqueous peroxygen bleach-containing composition comprising an ethoxylated nonionic surfactant and a zwitterionic betaine surfactant improves the physical stability of these compositions upon prolonged periods of storage.

Advantageously, the addition of C3–C6 alkyl ammonium salts and/or solvents as defined herein, in a liquid aqueous peroxygen bleach-containing composition comprising an ethoxylated nonionic surfactant and a zwitterionic betaine surfactant improves the rheological stability of such compositions. Indeed, the initial viscosity of the compositions herein is maintained constant (typically do not undergo more than 40%, preferably not more than 30%) when these compositions are used in a wide range of temperatures, typically from 10° C. to 45° C. Also these compositions are clear in a broad range of temperature, e.g. up to 45° C.

It is a further object of the present invention to provide such an improved liquid bleaching composition with low viscosity which is also a clear composition in a broad range of temperature, e.g. up to 45° C.

An advantage of the compositions of the present invention is that they exhibit a great flexibility in the soils they may clean. Although the compositions of the present invention are primarily formulated to be used as a laundry pretreater in its neat form, they may also be used in other laundry applications e.g., as a laundry detergent or a laundry additive, or even in other household applications like in hard surface cleaning applications. Accordingly, the compositions according to the present invention are able to perform in a variety of conditions, i.e., in hard and soft water in diluted form.

SUMMARY OF THE INVENTION

The present invention encompasses a liquid aqueous composition having a viscosity of 1 cps to 100 cps when measured with a Brookfield viscometer at spindle 2, rpm 30 and 20° C. and comprising a peroxygen bleach, from 0.001% to 30% by weight of the total composition of an ethoxylated nonionic surfactant, from 0.001% to 20% by weight of a zwitterionic betaine surfactant and a viscosity controlling agent selected from the group consisting of:

C3–C6 alkyl ammonium salt, glycol according to the formula:

$$R_1—O—(C_x—H_{2x})_n—R_2,$$

wherein $R_1$ is a saturated or unsaturated, substituted or unsubstituted, linear or branched alkyl group containing from 1 to 5 carbon atoms, $R_2$ is hydrogen or a saturated or unsaturated, substituted or unsubstituted, linear or branched alkyl group containing from 1 to 5 carbon atoms, x ranges from 2 to 4 and n ranges from 1 to 5;

an alcohol having the formula $R_a$—OH wherein $R_a$ is a linear or branched, saturated or unsaturated alkyl group containing from 3 to 8 carbon atoms, an aromatic alcohol according to the formula $R_b$—OH wherein $R_b$ is an alkyl substituted or non-alkyl substituted aryl group containing from 5 to 15 carbon atoms, and mixtures thereof.

The present invention further encompasses process of pretreating fabrics wherein, the composition of the present invention is applied neat on the fabrics, and the fabrics are subsequently rinsed,or washed in a normal wash cycle and then rinsed with water.

DETAILED DESCRIPTION OF THE INVENTION

The Liquid Cleaning Composition

The compositions according to the present invention are liquid compositions as opposed to a solid or a gas. As used herein "liquid" includes "pasty" compositions. The liquid compositions herein are aqueous compositions.

Typically, the liquid aqueous compositions herein comprise from 10% to 99.9% by weight of the total composition of water, preferably from 30% to 97%, even more preferably from 50% to 95% and more preferably from 60% to 90%.

Typically, the liquid compositions according to the present invention have a pH up to 7, preferably from 1 to 6, and more preferably from 1.5 to 5.5. Formulating the compositions according to the present invention in the acidic pH range contributes to the chemical stability of the compositions and to the stain removal performance of the compositions. The pH of the compositions may be adjusted by any acid or base known to those skilled in the art. Examples of such agents are inorganic acids such as sulphuric acid and strong bases such as sodium hydroxide.

Peroxygen Bleach

As a first essential element the compositions according to the present invention comprise a peroxygen bleach or a mixture thereof. Indeed, the presence of peroxygen bleach contributes to the excellent bleaching benefits of said compositions. Suitable peroxygen bleaches for use herein are hydrogen peroxide, water soluble sources thereof, or mixtures thereof. As used herein a hydrogen peroxide source refers to any compound which produces perhydroxyl ions when said compound is in contact with water.

Suitable water-soluble sources of hydrogen peroxide for use herein include percarbonates, persilicates, persulphates such as monopersulfate, perborates, peroxyacids such as diperoxydodecandioic acid (DPDA), magnesium perphtalic acid, perlauric acid, perbenzoic and alkylperbenzoic acids, hydroperoxides, aliphatic and aromatic diacyl peroxides, and mixtures thereof. Preferred peroxygen bleaches herein are hydrogen peroxide, hydroperoxide and/or diacyl peroxide. Hydrogen peroxide is the most preferred peroxygen bleach herein.

Suitable hydroperoxides for use herein are tert-butyl hydroperoxide, cumyl hydroperoxide, 2,4,4-trimethylpentyl-2-hydroperoxide, di-isopropylbenzene-monohydroperoxide, tert-amyl hydroperoxide and 2,5-dimethyl-hexane-2,5-dihydroperoxide. Such hydroperoxides have the advantage to be particularly safe to fabrics and colour while delivering excellent bleaching performance when used in any laundry application.

Suitable aliphatic diacyl peroxides for use herein are dilauroyl peroxide, didecanoyl peroxide, dimyristoyl peroxide, or mixtures thereof. Suitable aromatic diacyl peroxide for use herein is for example benzoyl peroxide. Such diacyl peroxides have the advantage to be particularly safe to fabrics and colour while delivering excellent bleaching performance when used in any laundry application.

Typically, the compositions herein comprise from 0.01% to 20% by weight of the total composition of said peroxygen bleach or mixtures thereof, preferably from 1% to 15% and more preferably from 2% to 10%.

Ethoxylated Nonionic Surfactant

As a second essential element the compositions according to the present invention comprise an ethoxylated nonionic surfactant or a mixture thereof at a level of from 0.001% to 30% by weight of the total composition. Preferably, the compositions herein comprise from 0.01% to 15% by weight of the total composition of said ethoxylated nonionic surfactant or mixture thereof, more preferably from 0.5% to 10%, even more preferably from 0.5% to 9% and most preferably from 1% to 6%.

Suitable ethoxylated nonionic surfactants herein are ethoxylated nonionic surfactants according to the formula RO—$(C_2H_4O)_nH$, wherein R is a $C_6$ to $C_{22}$ alkyl chain or a $C_6$ to $C_{28}$ alkyl benzene chain, and wherein n is from 0 to 20, preferably from 1 to 15 and, more preferably from 2 to 15 and most preferably from 2 to 12. The preferred R chains for use herein are the $C_8$ to $C_{22}$ alkyl chains.

Preferred ethoxylated nonionic surfactants are according to the formula above and have an HLB (hydrophilic-lipophilic balance) below 16, preferably below 15, and more preferably below 14. Those ethoxylated nonionic surfactants have been found to provide good grease cutting properties.

Accordingly suitable ethoxylated nonionic surfactants for use herein are Dobanol$^R$ 91-2.5 (HLB=8.1; R is a mixture of $C_9$ and $C_{11}$ alkyl chains, n is 2.5), or Lutensol$^R$ TO3 (HLB=8; R is a $C_{13}$ alkyl chains, n is 3), or Lutensol$^R$ AO3 (HLB=8; R is a mixture of $C_{13}$ and $C_{15}$ alkyl chains, n is 3), or Tergitol$^R$ 25L3 (HLB=7.7; R is in the range of $C_{12}$ to $C_{15}$ alkyl chain length, n is 3), or Dobanol$^R$ 23-3 (HLB=8.1; R is a mixture of $C_{12}$ and $C_{13}$ alkyl chains, n is 3), or Dobanol$^R$ 23-2 (HLB=6.2; R is a mixture of $C_{12}$ and $C_{13}$ alkyl chains, n is 2), or Dobanol$^R$ 45-7 (HLB=11.6; R is a mixture of $C_{14}$ and $C_{15}$ alkyl chains, n is 7) Dobanol$^R$ 23-6.5 (HLB=11.9; R is a mixture of $C_{12}$ and $C_{13}$ alkyl chains, n is 6.5), or Dobanol$^R$ 25-7 (HLB=12; R is a mixture of $C_{12}$ and $C_{15}$ alkyl chains, n is 7), or Dobanol$^R$ 91-5 (HLB=11.6; R is a mixture of $C_9$ and $C_{11}$ alkyl chains, n is 5), or Dobanol$^R$ 91-6 (HLB=12.5; R is a mixture of $C_9$ and $C_{11}$ alkyl chains, n is 6), or Dobanol$^R$ 91-8 (HLB=13.7; R is a mixture of $C_9$ and $C_{11}$ alkyl chains, n is 8), Dobanol$^R$ 91-10 (HLB=14.2; R is a mixture of $C_9$ to $C_{11}$ alkyl chains, n is 10), or mixtures thereof. Preferred herein are Dobanol$^R$ 91-2.5, or Lutensol$^R$ TO3, or Lutensol$^R$ AO3, or Tergitol$^R$ 25L3, or Dobanol$^R$ 23-3, or Dobanol R$^R$ 23-2, or mixtures thereof. These Dobanol$^R$ surfactants are commercially available from SHELL. These Lutensol$^R$ surfactants are commercially available from BASF and these Tergitol$^R$ surfactants are commercially available from UNION CARBIDE.

Suitable chemical processes for preparing the ethoxylated nonionic surfactants for use herein include condensation of corresponding alcohols with alkylene oxide, in the desired proportions. Such processes are well-known to the man skilled in the art and have been extensively described in the art.

The compositions herein may desirably comprise one of those ethoxylated nonionic surfactants or a mixture of those ethoxylated nonionic surfactants having different HLBs (hydrophilic-lipophilic balance). In a preferred embodiment the compositions herein comprise an ethoxylated nonionic surfactant according to the above formula and having an HLB up to 10 (i.e., a so called hydrophobic ethoxylated nonionic surfactant), preferably below 10, more preferably below 9, and an ethoxylated nonionic surfactant according to the above formula and having an HLB above 10 to 16 (i.e., a so called hydrophilic ethoxylated nonionic surfactant), preferably from 11 to 14. Indeed, in this preferred embodiment the compositions of the present invention typically comprise from 0.01% to 15% by weight of the total composition of said hydrophobic ethoxylated nonionic surfactant, preferably from 0.5% to 10% and from 0.01% to 15% by weight of said hydrophilic ethoxylated nonionic surfactant, preferably from 0.5% to 10%. Such mixtures of ethoxylated nonionic surfactants with different HLBs may be desired as they allow optimum grease cleaning removal performance on a broader range of greasy soils having different hydrophobic/hydrophilic characters.

Zwitterionic Betaine Surfactants

As a third essential element the compositions according to the present invention comprise a zwitterionic betaine surfactant or a mixture thereof at a level of from 0.001% to 20% by weight of the total composition. Preferably, the compositions herein comprise from 0.01% to 10% by weight of the total composition of said zwitterionic betaine surfactant or mixture thereof, more preferably from 0.5% to 8% and most preferably from 1% to 5%.

Suitable zwitterionic betaine surfactants for use herein contain both a cationic hydrophilic group, i.e., a quaternary ammonium group, and anionic hydrophilic group on the same molecule at a relatively wide range of pH's. The typical anionic hydrophilic groups are carboxylates and sulfonates, although other groups like sulfates, phosphonates, and the like can be used. A generic formula for the zwitterionic betaine surfactants to be used herein is:

$$R_1—N^+(R_2)(R_3)R_4X^-$$

wherein $R_1$ is a hydrophobic group; $R_2$ is hydrogen, $C_1$–$C_6$ alkyl, hydroxy alkyl or other substituted $C_1$–$C_6$ alkyl group; $R_3$ is $C_1$–$C_6$ alkyl, hydroxy alkyl or other substituted $C_1$–$C_6$ alkyl group which can also be joined to $R_2$ to form ring structures with the N, or a $C_1$–$C_6$ carboxylic acid group or a $C_1$–$C_6$ sulfonate group; $R_4$ is a moiety joining the cationic nitrogen atom to the hydrophilic group and is typically an alkylene, hydroxy alkylene, or polyalkoxy group containing from 1 to 10 carbon atoms; and X is the hydrophilic group which is a carboxylate or sulfonate group.

Preferred hydrophobic groups $R_1$ are aliphatic or aromatic, saturated or unsaturated, substituted or unsubstituted hydrocarbon chains that can contain linking groups such as amido groups, ester groups. More preferred $R_1$ is an alkyl group containing from 1 to 24 carbon atoms, preferably from 8 to 18, and more preferably from 10 to 16. These simple alkyl groups are preferred for cost and stability reasons. However, the hydrophobic group $R_1$ can also be an amido radical of the formula $R_a—C(O)—NH—(C(R_b)_2)_m$, wherein $R_a$ is an aliphatic or aromatic, saturated or unsaturated, substituted or unsubstituted hydrocarbon chain, preferably an alkyl group containing from 8 up to 20 carbon atoms, preferably up to 18, more preferably up to 16, $R_b$ is selected from the group consisting of hydrogen and hydroxy groups, and m is from 1 to 4, preferably from 2 to 3, more preferably 3, with no more than one hydroxy group in any $(C(R_b)_2)$ moiety.

Preferred $R_2$ is hydrogen, or a $C_1$–$C_3$ alkyl and more preferably methyl. Preferred $R_3$ is a $C_1$–$C_4$ carboxylic acid group or C1–C4 sulfonate group, or a $C_1$–$C_3$ alkyl and more preferably methyl. Preferred $R_4$ is $(CH_2)_n$ wherein n is an integer from 1 to 10, preferably from 1 to 6, more preferably is from 1 to 3.

Some common examples of betaine/sulphobetaine are described in U.S. Pat. Nos. 2,082,275, 2,702,279 and 2,255,082, incorporated herein by reference.

Examples of particularly suitable alkyldimethyl betaines include coconut-dimethyl betaine, lauryl dimethyl betaine, decyl dimethyl betaine, 2-(N-decyl-N,N-dimethylammonia)acetate, 2-(N-coco N,N-dimethylammonio) acetate, myristyl dimethyl betaine, palmityl dimethyl betaine, cetyl dimethyl betaine, stearyl dimethyl betaine. For example Coconut dimethyl betaine is commercially available from Seppic under the trade name of Amonyl 265®. Lauryl betaine is commercially available from Albright & Wilson under the trade name Empigen BB/L®.

Examples of amidobetaines include cocoamidoethylbetaine, cocoamidopropyl betaine or C10–C14 fatty acylamidopropylene(hydropropylene) sulfobetaine. For example C10–C14 fatty acylamidopropylene(hydropropylene)sulfobetaine is commercially available from Sherex Company under the trade name "Varion CAS® sulfobetaine".

A further example of betaine is Lauryl-imminodipropionate commercially available from Rhone-Poulenc under the trade name Mirataine H2C-HA®.

Particularly preferred zwitterionic betaine surfactants for use herein are salt free, i.e. that the zwitterionic betaine surfactant raw material contains less than 5% by weight of salts, preferably less than 2%, more preferably less than 1% and most preferably from 0.01% to 0.5%.

By "salts" is in meant herein any material having as base unit, a couple of positive ion (or positive molecular ion) and negative ion (or negative molecular ion) containing one or more halogen atoms. Such salts include Sodium Chloride, Potassium Chloride, Sodium Bromide and the like.

Such salts free zwitterionic betaine surfactants are obtainable by conventional manufacturing processes like inverse osmosis or fractionated precipitation. For example inverse osmosis is based on the principle of contacting the zwitterionic betaine surfactant raw material (commercially available ) with a polar solvent (it is to be understood that such a solvent is free of salts) separated by a semi-permeable membrane for example acetate-cellulose. An adequate pressure is applied on the system to allow the salts to migrate from the surfactant raw material to the polar solvent phase. This way the zwitterionic betaine surfactant raw material is purified, i.e. the salts is subtracted from the raw material.

Advantageously, it has now been surprisingly found that the use of such salt free zwitterionic betaine surfactants delivers improved fabric safety and/or colour safety when pretreating fabrics with a peroxygen bleach-containing composition comprising the same, as compared to the use of the same zwitterionic betaine surfactants with higher amount of salts. Thus, in its broadest aspect, the present invention also encompasses the use of a composition comprising a salt free zwitterionic betaine surfactant and a peroxygen bleach for pretreating fabrics (for bleaching fabrics in a process wherein the composition is applied, in its neat form onto the fabrics before rinsing them or washing and then rinsing them with water) whereby colour safety is improved (i.e. colour damage/decoloration is reduced) and/or fabric safety is improved.

The betaine zwitterionic surfactants herein have the ability to further boost the stain removal performance delivered by the ethoxylated nonionic surfactants herein on greasy stains, while providing improved bleaching performance to the liquid peroxygen bleach-containing compositions of the present invention comprising them.

Indeed, a significant cooperation has been observed between these ingredients to get optimum stain removal performance on a variety of soils, from particulate to non-particulate soils from hydrophobic to hydrophilic soils under any household application and especially laundry application on both hydrophilic and hydrophobic fabrics.

Optimum stain removal performance and bleaching performance are obtained when the ethoxylated nonionic surfactant and the zwitterionic betaine surfactant are present in the compositions of the present invention comprising a peroxygen bleach (pH up to 7), at weight ratio of the ethoxylated nonionic surfactant to the zwitterionic betaine surfactant of from 0.01 to 20, preferably from 0.1 to 15, more preferably from 0.5 to 5 and most preferably from 0.8 to 3.

Advantageously, excellent stain removal performance and bleaching performance can be obtained with the compositions herein at low total level of surfactants. Typically, the compositions herein comprise from 0.01% to 20% by weight of the total composition of ethoxylated nonionic surfactant and zwitterionic betaine surfactant, preferably from 0.1% to 15%, more preferably from 0.5% to 10%, even more preferably below 10% and most preferably from 1% to 8%.

Indeed, the present invention is based on the finding that the use of zwitterionic betaine surfactant on top of the ethoxylated nonionic surfactant at the appropriate ratios, in a liquid aqueous composition comprising a peroxygen bleach (pH up to 7), boosts the bleaching performance and the removal of various types of stains including greasy stains (e.g., lipstick, olive oil, mayonnaise, vegetal oil, sebum, make-up), as compared to the bleaching and stain removal performance delivered by the same composition based only on one of these surfactants (i.e., ethoxylated nonionic surfactant or zwitterionic betaine surfactant) at equal total level of surfactants. For example, it is only at very high levels of nonionic surfactants, as compared the total level of ethoxylated nonionic surfactants and zwitterionic betaine surfactants present in the compositions of the present invention that similar grease cleaning benefit is observed.

The stain removal performance may be evaluated by the following test methods on various type of stains.

A suitable test method for evaluating the stain removal performance on a soiled fabric under pretreatment condition is the following: A composition according to the present invention is applied neat to a fabric preferably to the soiled portion of the fabric, left to act from 1 to 10 minutes, and said pretreated fabric is then washed according to common washing conditions, at a temperature of from 30° to 70° C. for from 10 to 100 minutes. The stain removal is then evaluated by comparing side by side the soiled fabric pretreated with the composition of the present invention with those pretreated with the reference, e.g., the same composition but comprising only an alkoxylated nonionic surfactant or only a zwitterionic betaine surfactant as the sole surfactant. A visual grading may be used to assign difference in panel units (psu) in a range from 0 to 4.

The bleaching performance may be evaluated as for the stain removal performance but the stains used are bleachable stains like coffee, tea and the like.

The Viscosity Controlling Agent

As a fourth essential element the compositions according to the present invention comprise a viscosity controlling agent.

The viscosity controlling agent suitable for use herein are selected from the group consisting of:

C3–C6 alkyl ammonium salt, glycol according to the formula:

$$R_1—O—(C_x—H_{2x})_n—R_2,$$

wherein $R_1$ is a saturated or unsaturated, substituted or unsubstituted, linear or branched alkyl group containing from 1 to 5 carbon atoms, $R_2$ is hydrogen or a saturated or unsaturated, substituted or unsubstituted, linear or branched alkyl group containing from 1 to 5 carbon atoms, x ranges from 2 to 4 and n ranges from 1 to 5;

an alcohol having the formula $R_a$—OH wherein $R_a$ is a linear or branched, saturated or unsaturated alkyl group containing from 3 to 8 carbon atoms, an aromatic alcohol according to the formula $R_b$—OH wherein $R_b$ is an alkyl substituted or non-alkyl substituted aryl group containing from 5 to 15 carbon atoms, and mixtures thereof.

Typically, the compositions herein comprises from 0.001% to 20% by weight of the total composition of such a viscosity controlling agent or mixture thereof, preferably from 0.001% to 10%, more preferably from 0.01% to 10% and most preferably from 0.05% to 5%.

Suitable alkyl ammonium salts for use herein are ammonium salts of bromide, chloride, iodide or sulphate containing from 3 to 6 carbon atoms, preferably from 4 to 5 carbon atoms. Example of such salts are tetra pentyl ammonium bromide and/or tetra-butyl ammonium bromide. They are both commercially available under their chemical name from Sigma-Aldrich or Flucka Chemicals.

Preferred glycols for use herein are according to the formula:

$$R_1—O—(C_x—H_{2x})_n—R_2,$$

wherein $R_1$ is a saturated or unsaturated, substituted or unsubstituted, linear or branched alkyl group containing from 2 to 4 carbon atoms, $R_2$ is hydrogen or a saturated or unsaturated, substituted or unsubstituted, linear or branched alkyl group containing from 1 to 4 carbon atoms, preferably hydrogen or a C1–C4 alkyl group, more preferably hydrogen or methyl, x ranges from 2 to 3, more preferably 2 and n ranges from 1 to 3.

Examples of such glycols for use herein include DiEthylene Glycol Butyl Ether (also called Butyl Carbitol), DiEthylene Glycol methyl Butyl, DiPropilene Glycol Butyl Ether and/or DiPropilene Glycol methyl Butyl Ether. For example DiEthylene Glycol Butyl Ether may be commercially available from Fluka and Aldrich under its chemical name.

Preferred alcohols for use herein are those having the formula $R_a$—OH wherein $R_a$ is a linear or branched, saturated or unsaturated alkyl group containing from 3 to 8 carbon atoms, preferably from 4 to 8 and more preferably from 4 to 7 or mixtures thereof.

Example of such alcohols include butanol, isobutanol, pentanol and/or isopentilic alcohol. Such alcohols may be commercially available from Fluka and Aldrich under their chemical name.

Preferred aromatic alcohols for used herein are those according to the formula $R_b$—OH wherein $R_b$ is an alkyl substituted or non-alkyl substituted aryl group containing from 5 to 15 carbon atoms, preferably from 5 to 12, or mixtures thereof.

Examples of such aromatic alcohol include benzyl alcohol. Benzyl alcohol is commercially available from Fluka.

In a preferred embodiment herein optimum viscosity properties are obtained at a weigh ratio of the viscosity controlling agent to the zwitterionic betaine surfactant of 0.01 to 10, preferably of 0.1 to 1.0 and more preferably of 0.2 to 0.5.

The viscosity of the compositions herein is from 1 cps to 100 cps, preferably from 5 cps to 80 cps, more preferably from 10 cps to 50 cps and most preferably from 10 cps to 30 cps, when measured with a Brookfield Viscometer at spindle 2, rpm 30 and 20° C.

Importantly, in the present invention the improved stain removal benefit and bleaching benefit are delivered with a liquid composition which is a water-like, clear and transparent composition.

The appearance of a composition can be evaluated via turbidimetric analysis. For example, the transparency of a composition can be evaluated by measuring its absorbency via a spectrophotometer at 800 nm wave length.

The viscosity controlling agents herein allow to deliver the required viscosity to the compositions herein. Not to be bound by theory, it is speculated that the ammonium salts herein impacts on the electrostatic interactions connecting the charged nonionic/zwitterionic micelles and thus reduce the viscosity of the compositions. Indeed, the nonionic surfactants in the compositions herein are bound together with the zwitterionic betaine surfactants so as to forms charged micelles (thereby reducing the surfactant surface interface with the water phase of the compositions herein). The charged micelles so formed interact together so as to form elongated structures, i.e., micelles connected via electrostatic interactions that results in increased viscosity. Also the presence of glycols, alcohols, and/or aromatic alcohols will compete with the zwitterionic betaine surfactants in order to form such micelles so as to make the resulting micelles less suitable to form elongated structures and hence to increase the viscosity of the compositions.

An advantage of the compositions of the present invention is that they are physically and chemically stable upon prolonged periods of storage.

Chemical stability of the compositions herein may be evaluated by measuring the concentration of available oxygen (often abbreviated to AvO2) at given storage time after having manufactured the compositions. The concentration of available oxygen can be measured by chemical titration methods known in the art, such as the iodometric method, thiosulphatimetric method, the permanganometric method and the cerimetric method. Said methods and the criteria for the choice of the appropriate method are described for example in "Hydrogen Peroxide", W. C. Schumb, C. N. Satterfield and R. L. Wentworth, Reinhold Publishing Corporation, New York, 1955 and "Organic Peroxides", Daniel Swern, Editor Wiley Int. Science, 1970.

By "physically stable", it is meant herein that no phase separation occurs in the compositions for a period of 7 days at 50° C.

Optional Ingredients

The compositions herein may further comprise a variety of other optional ingredients such as chelating agents, builders, other surfactants, stabilisers, bleach activators, soil suspenders, soil suspending polyamine polymers, polymeric soil release agents, radical scavengers, catalysts, dye transfer agents, solvents, brighteners, perfumes, pigments and dyes.

Chelating Agents

Accordingly, the compositions of the present invention may comprise a chelating agent as a preferred optional ingredient. Suitable chelating agents may be any of those known to those skilled in the art such as the ones selected from the group comprising phosphonate chelating agents, amino carboxylate chelating agents, other carboxylate chelating agents, polyfunctionally-substituted aromatic chelating agents, ethylenediamine N,N'-disuccinic acids, or mixtures thereof.

A chelating agent may be desired in the compositions of the present invention as it may contribute to reduce tensile strength loss of fabrics and/or colour damage, when used in a laundry pretreatment application. Indeed, the chelating agents inactivate the metal ions present on the surface of the fabrics and/or in the compositions that otherwise would contribute to the radical decomposition of the peroxygen bleach.

Suitable phosphonate chelating agents for use herein may include alkali metal ethane 1-hydroxy diphosphonates (HEDP), alkylene poly (alkylene phosphonate), as well as amino phosphonate compounds, including amino aminotri (methylene phosphonic acid) (ATMP), nitrilo trimethylene phosphonates (NTP), ethylene diamine tetra methylene phosphonates, and diethylene triamine penta methylene phosphonates (DTPMP). The phosphonate compounds may be present either in their acid form or as salts of different cations on some or all of their acid functionalities. Preferred phosphonate chelating agents to be used herein are diethylene triamine penta methylene phosphonate (DTPMP) and ethane 1-hydroxy diphosphonate (HEDP). Such phosphonate chelating agents are commercially available from Monsanto under the trade name DEQUEST®.

Polyfunctionally-substituted aromatic chelating agents may also be useful in the compositions herein. See U.S. Pat. No. 3,812,044, issued May 21, 1974, to Connor et al. Preferred compounds of this type in acid form are dihydroxydisulfobenzenes such as 1,2-dihydroxy-3,5-disulfobenzene.

A preferred biodegradable chelating agent for use herein is ethylene diamine N,N'-disuccinic acid, or alkali metal, or alkaline earth, ammonium or substitutes ammonium salts thereof or mixtures thereof. Ethylenediamine N,N'-disuccinic acids, especially the (S,S) isomer have been extensively described in U.S. Pat. No. 4,704,233, Nov. 3, 1987, to Hartman and Perkins. Ethylenediamine N,N'-disuccinic acids is, for instance, commercially available under the tradename ssEDDS® from Palmer Research Laboratories.

Suitable amino carboxylates for use herein include ethylene diamine tetra acetates, diethylene triamine pentaacetates, diethylene triamine pentaacetate (DTPA), N-hydroxyethylethylenediamine triacetates, nitrilotriacetates, ethylenediamine tetrapropionates, triethylenetetraaminehexaacetates, ethanol-diglycines, propylene diamine tetracetic acid (PDTA) and methyl glycine di-acetic acid (MGDA), both in their acid form, or in their alkali metal, ammonium, and substituted ammonium salt forms. Particularly suitable amino carboxylates to be used herein are diethylene triamine penta acetic acid, propylene diamine tetracetic acid (PDTA) which is, for instance, commercially available from BASF under the trade name Trilon FS® and methyl glycine di-acetic acid (MGDA).

Further carboxylate chelating agents for use herein include salicylic acid, aspartic acid, glutamic acid, glycine, malonic acid or mixtures thereof.

Another chelating agent for use herein is of the formula:

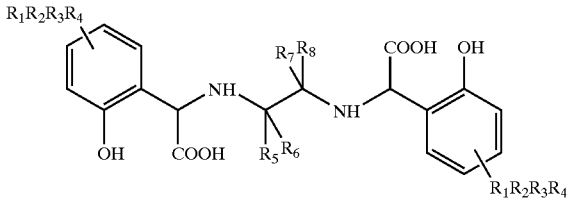

wherein $R_1$, $R_2$, $R_3$, and $R_4$ are independently selected from the group consisting of —H, alkyl, alkoxy, aryl, aryloxy, —Cl, —Br, —$NO_2$, —C(O)R', and —$SO_2$R"; wherein R' is selected from the group consisting of —H, —OH, alkyl, alkoxy, aryl, and aryloxy; R" is selected from the group consisting of alkyl, alkoxy, aryl, and aryloxy; and $R_5$, $R_6$, $R_7$, and $R_8$ are independently selected from the group consisting of —H and alkyl.

Particularly preferred chelating agents for use herein are amino aminotri(methylene phosphonic acid), di-ethylenetriamino-pentaacetic acid, diethylene triamine penta methylene phosphonate, 1-hydroxy ethane diphosphonate, ethylenediamine N,N'-disuccinic acid, and mixtures thereof.

Typically, the compositions according to the present invention comprise up to 5% by weight of the total composition of a chelating agent, or mixtures thereof, preferably from 0.01% to 1.5% by weight and more preferably from 0.01% to 0.5%.

Surfactants

The compositions of the present invention may further comprise other surfactants than the ones mentioned hereinbefore including other nonionic surfactants, anionic surfactants, cationic surfactants and/or amphoteric surfactants.

Typically, the compositions according to the present invention may comprise from 0.01% to 30% by weight of the total composition of another surfactant on top of the zwitterionic betaine surfactant and ethoxylated nonionic surfactant, preferably from 0.1% to 25% and more preferably from 0.5% to 20%.

Suitable nonionic surfactants for use herein include polyhydroxy fatty acid amide surfactants, or mixtures thereof, according to the formula:

$$R^2—C(O)—N(R^1)—Z,$$

wherein $R^1$ is H, or $C_1$–$C_4$ alkyl, $C_1$–$C_4$ hydrocarbyl, 2-hydroxy ethyl, 2-hydroxy propyl or a mixture thereof, $R^2$ is $C_5$–$C_{31}$ hydrocarbyl, and Z is a polyhydroxyhydrocarbyl having a linear hydrocarbyl chain with at least 3 hydroxyls directly connected to the chain, or an alkoxylated derivative thereof.

Preferably, $R^1$ is $C_1$–$C_4$ alkyl, more preferably $C_1$ or $C_2$ alkyl and most preferably methyl, $R^2$ is a straight chain $C_7$–$C_{19}$ alkyl or alkenyl, preferably a straight chain $C_9$–$C_{18}$ alkyl or alkenyl, more preferably a straight chain $C_{11}$–$C_{18}$ alkyl or alkenyl, and most preferably a straight chain $C_{11}$–$C_{14}$ alkyl or alkenyl, or mixtures thereof. Z preferably will be derived from a reducing sugar in a reductive amination reaction; more preferably Z is a glycityl. Suitable reducing sugars include glucose, fructose, maltose, lactose, galactose, mannose and xylose. As raw materials, high dextrose corn syrup, high fructose corn syrup, and high maltose corn syrup can be utilised as well as the individual sugars listed above. These corn syrups may yield a mix of sugar components for Z. It should be understood that it is by no means intended to exclude other suitable raw materials. Z preferably will be selected from the group consisting of —$CH_2$—$(CHOH)_n$—$CH_2OH$, —$CH(CH_2OH)$—$(CHOH)_{n-1}$—$CH_2OH$, —$CH_2$—$(CHOH)_2$—(CHOR')(CHOH)—$CH_2OH$, where n is an integer from 3 to 5, inclusive, and R' is H or a cyclic or aliphatic monosaccharide, and alkoxylated derivatives thereof. Most preferred are glycityls wherein n is 4, particularly $CH_2$—$(CHOH)_4$—$CH_2OH$.

In formula $R^2$—C(O)—N($R^1$)—Z, $R^1$ can be, for example, N-methyl, N-ethyl, N-propyl, N-isopropyl, N-butyl, N-2-hydroxy ethyl, or N-2-hydroxy propyl. $R^2$—C(O)—N< can be, for example, cocamide, stearamide, oleamide, lauramide, myristamide, capricamide, palmitamide, tallowamide and the like. Z can be 1-deoxyglucityl, 2-deoxyfructityl, 1-deoxymaltityl, 1-deoxylactityl, 1-deoxygalactityl, 1-deoxymannityl, 1-deoxymaltotriotityl and the like.

Suitable polyhydroxy fatty acid amide surfactants for use herein may be commercially available under the trade name HOE® from Hoechst.

Methods for making polyhydroxy fatty acid amide surfactants are known in the art. In general, they can be made by reacting an alkyl amine with a reducing sugar in a reductive amination reaction to form a corresponding N-alkyl polyhydroxyamine, and then reacting the N-alkyl polyhydroxyamine with a fatty aliphatic ester or triglyceride in a condensation/amidation step to form the N-alkyl, N-polyhydroxy fatty acid amide product. Processes for making compositions containing polyhydroxy fatty acid amides are disclosed for example in GB patent specification 809,060, published Feb. 18, 1959, by Thomas Hedley & Co., Ltd., U.S. Pat. No. 2,965,576, issued Dec. 20, 1960 to E. R. Wilson, U.S. Pat. No. 2,703,798, Anthony M. Schwartz, issued Mar. 8, 1955, U.S. Pat. No. 1,985,424, issued Dec. 25, 1934 to Piggott and WO92/06070, each of which is incorporated herein by reference.

Suitable anionic surfactants for use in the compositions herein include water-soluble salts or acids of the formula $ROSO_3M$ wherein R preferably is a $C_{10}$–$C_{24}$ hydrocarbyl, preferably an alkyl or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium, potassium, lithium), or ammonium or substituted ammonium (e.g., methyl-, dimethyl-, and trimethyl ammonium cations and quaternary ammonium cations, such as tetramethyl-ammonium and dimethyl piperdinium cations and quaternary ammonium cations derived from alkylamines such as ethylamine, diethylamine, triethylamine, and mixtures thereof, and the like). Typically, alkyl chains of $C_{12-16}$ are preferred for lower wash temperatures (e.g., below about 50° C.) and $C_{16-18}$ alkyl chains are preferred for higher wash temperatures (e.g., above about 50° C.).

Other suitable anionic surfactants for use herein are water-soluble salts or acids of the formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines such as ethylamine, diethylamine, triethylamine, mixtures thereof, and the like. Exemplary surfactants are $C_{12}$–$C_{18}$ alkyl polyethoxylate (1.0) sulfate, $C_{12}$–$C_{18}$E(1.0)M), $C_{12}$–$C_{18}$ alkyl polyethoxylate (2.25) sulfate, $C_{12}$–$C_{18}$E(2.25)M), $C_{12}$–$C_{18}$ alkyl polyethoxylate (3.0) sulfate $C_{12}$–$C_{18}$E(3.0), and $C_{12}$–$C_{18}$ alkyl polyethoxylate (4.0) sulfate $C_{12}$–$C_{18}$E(4.0)M), wherein M is conveniently selected from sodium and potassium.

Other anionic surfactants useful for detersive purposes can also be used herein. These can include salts (including, for example, sodium, potassium, ammonium, and substituted ammonium salts such as mono-, di- and triethanolamine salts) of soap, $C_9$–$C_{20}$ linear alkylbenzenesulfonates, $C_8$–$C_{22}$ primary or secondary alkanesulfonates, $C_8$–$C_{24}$ olefinsulfonates, sulfonated polycarboxylic acids prepared by sulfonation of the pyrolyzed product of alkaline earth metal citrates, e.g., as described in British patent specification No. 1,082,179, $C_8$–$C_{24}$ alkylpolyglycolethersulfates (containing up to 10 moles of ethylene oxide); alkyl ester sulfonates such as $C_{14-16}$ methyl ester sulfonates; acyl glycerol sulfonates, fatty oleyl glycerol sulfates, alkyl phenol ethylene oxide ether sulfates, paraffin sulfonates, alkyl phosphates, isethionates such as the acyl isethionates, N-acyl taurates, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), sulfates of alkylpolysaccharides such as the sulfates of alkylpolyglucoside (the nonionic nonsulfated compounds being described below), branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation. Resin acids and hydrogenated resin acids are also suitable, such as rosin, hydrogenated rosin, and resin acids and hydrogenated resin acids present in or derived from tall oil. Further examples are given in "Surface Active Agents and Detergents" (Vol. I and II by Schwartz, Perry and Berch). A variety of such surfactants are also generally disclosed in U.S. Pat. No. 3,929,678, issued Dec. 30, 1975, to Laughlin, et al. at Column 23, line 58 through Column 29, line 23 (herein incorporated by reference).

Other suitable anionic surfactants for use herein also include acyl sarcosinate or mixtures thereof, in its acid and/or salt form, preferably long chain acyl sarcosinates having the following formula:

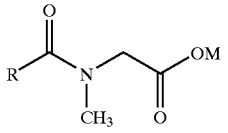

wherein M is hydrogen or a cationic moiety and wherein R is an alkyl group of from 11 to 15 carbon atoms, preferably of from 11 to 13 carbon atoms. Preferred M are hydrogen and alkali metal salts, especially sodium and potassium. Said acyl sarcosinate surfactants are derived from natural fatty acids and the amino-acid sarcosine (N-methyl glycine). They are suitable to be used as aqueous solution of their salt or in their acidic form as powder. Being derivatives of natural fatty acids, said acyl sarcosinates are rapidly and completely biodegradable and have good skin compatibility.

Accordingly, suitable long chain acyl sarcosinates to be used herein include $C_{12}$ acyl sarcosinate (i.e., an acyl sarcosinate according to the above formula wherein M is hydrogen and R is an alkyl group of 11 carbon atoms) and $C_{14}$ acyl sarcosinate (i.e., an acyl sarcosinate according to the above formula wherein M is hydrogen and R is an alkyl group of 13 carbon atoms). $C_{12}$ acyl sarcosinate is commercially available, for example, as Hamposyl L-30® supplied by Hampshire. $C_{14}$ acyl sarcosinate is commercially available, for example, as Hamposyl M-30® supplied by Hampshire.

Suitable amphoteric surfactants for use herein include amine oxides having the following formula $R_1R_2R_3NO$ wherein each of R1, R2 and R3 is independently a saturated substituted or unsubstituted, linear or branched hydrocarbon chains of from 1 to 30 carbon atoms. Preferred amine oxide surfactants to be used according to the present invention are amine oxides having the following formula $R_1R_2R_3NO$ wherein R1 is an hydrocarbon chain comprising from 1 to 30 carbon atoms, preferably from 6 to 20, more preferably from 8 to 16, most preferably from 8 to 12, and wherein R2 and R3 are independently substituted or unsubstituted, linear or branched hydrocarbon chains comprising from 1 to 4 carbon atoms, preferably from 1 to 3 carbon atoms, and more preferably are methyl groups. R1 may be a saturated substituted or unsubstituted linear or branched hydrocarbon chain. Suitable amine oxides for use herein are for instance natural blend C8–C10 amine oxides as well as C12–C16 amine oxides commercially available from Hoechst.

Radical Scavengers

The compositions of the present invention may comprise a radical scavenger or a mixture thereof. Suitable radical scavengers for use herein include the well-known substituted mono and dihydroxy benzenes and their analogs, alkyl and aryl carboxylates and mixtures thereof. Preferred such radical scavengers for use herein include di-tert-butyl hydroxy toluene (BHT), hydroquinone, di-tert-butyl hydroquinone, mono-tert-butyl hydroquinone, tert-butyl-hydroxy anysole, benzoic acid, toluic acid, catechol, t-butyl catechol, benzylamine, 1,1,3-tris(2-methyl-4-hydroxy-5-t-butylphenyl) butane, n-propyl-gallate or mixtures thereof and highly preferred is di-tert-butyl hydroxy toluene. Such radical scavengers like N-propyl-gallate may be commercially available from Nipa Laboratories under the trade name Nipanox S1®. Radical scavengers when used, are typically present herein in amounts ranging up to 10% by weight of the total composition and preferably from 0.001% to 0.5% by weight.

The presence of radical scavengers may contribute to reduce tensile strength loss of fabrics and/or colour damage when the compositions of the present invention are used in a laundry pretreatment application.

Antioxidants

The compositions according to the present invention may further comprise an antioxidant or mixtures thereof. Typically, the compositions herein comprise up to 10% by weight of the total composition of an antioxidant or mixtures thereof, preferably from 0.002% to 5%, more preferably from 0.005% to 2%, and most preferably from 0.01% to 1%.

Suitable antioxidants for use herein include organic acids like citric acid, ascorbic acid, tartaric acid, adipic acid and sorbic acid, or amines like lecithin, or aminoacids like glutamine, methionine and cysteine, or esters like ascorbil palmitate, ascorbil stearate and triethylcitrate, or mixtures thereof. Preferred antioxidants for use herein are citric acid, ascorbic acid, ascorbil palmitate, lecithin or mixtures thereof.

Bleach Activators

As an optional ingredient, the compositions of the present invention may comprise a bleach activator or mixtures thereof. By "bleach activator", it is meant herein a compound which reacts with hydrogen peroxide to form a peracid. The peracid thus formed constitutes the activated bleach. Suitable bleach activators to be used herein include those belonging to the class of esters, amides, imides, or anhydrides. Examples of suitable compounds of this type are disclosed in British Patent GB 1 586 769 and GB 2 143 231 and a method for their formation into a prilled form is described in European Published Patent Application EP-A-62 523. Suitable examples of such compounds to be used herein are tetracetyl ethylene diamine (TAED), sodium 3,5,5 trimethyl hexanoyloxybenzene sulphonate, diperoxy dodecanoic acid as described for instance in U.S. Pat. No. 4,818,425 and nonylamide of peroxyadipic acid as described for instance in U.S. Pat. No. 4,259,201 and n-nonanoyloxybenzenesulphonate (NOBS). Also suitable are N-acyl caprolactams selected from the group consisting of substituted or unsubstituted benzoyl caprolactam, octanoyl caprolactam, nonanoyl caprolactam, hexanoyl caprolactam, decanoyl caprolactam, undecenoyl caprolactam, formyl caprolactam, acetyl caprolactam, propanoyl caprolactam, butanoyl caprolactam pentanoyl caprolactam or mixtures thereof. A particular family of bleach activators of interest was disclosed in EP 624 154, and particularly preferred in that family is acetyl triethyl citrate (ATC). Acetyl triethyl citrate has the advantage that it is environmental-friendly as it eventually degrades into citric acid and alcohol. Furthermore, acetyl triethyl citrate has a good hydrolytical stability in the product upon storage and it is an efficient bleach activator. Finally, it provides good building capacity to the composition. The compositions according to the present invention may comprise from 0.01% to 20% by weight of the total composition of said bleach activator, or mixtures thereof, preferably from 1% to 10%, and more preferably from 3% to 7%

Process of Pretreating Fabrics

In the present invention, the liquid aqueous composition of the present invention is applied neat onto at least a portion of a soiled fabric, optionally left to act onto said fabric, typically for a period of time of a few seconds to several hours, before the fabric is rinsed, or washed then rinsed.

In this mode, the neat compositions can optionally be left to act onto said fabrics for a period of time ranging from 10 seconds to 1 hour, preferably 1 minute to 15 minutes, more preferably 1 minute to 5 minutes before the fabrics are rinsed, or washed then rinsed, provided that the composition is not left to dry onto said fabrics. For particularly though stains, it may be appropriate to further rub or brush said fabrics by means of a sponge or a brush, or by rubbing two pieces of fabrics against each other.

By "washing", it is to be understood herein that the fabrics are contacted with a conventional detergent composition comprising at least one surface active agent in an aqueous bath, this washing may occur by means of a washing machine or simply by hands.

By "in its neat form", it is to be understood that the liquid compositions are applied directly onto the fabrics to be pretreated without undergoing any dilution, i.e. the liquid aqueous compositions herein are applied onto the fabrics as described herein.

According to the process of pretreating soiled fabrics of the present invention, the liquid aqueous compositions herein should preferably not be left to dry onto the fabrics. It has been found that water evaporation contributes to increase the concentration of free radicals onto the surface of the fabrics and, consequently, the rate of chain reaction. It is also speculated that an auto-oxidation reaction occurs upon evaporation of water when the liquid compositions are left to dry onto the fabrics. Said reaction of auto-oxidation generates peroxy-radicals which may contribute to the degradation of cellulose. Thus, not leaving the liquid compositions, as described herein, to dry onto the fabrics, in a process of pretreating soiled fabrics, contributes to reduce the tensile strength loss and/or colour damage when pretreating fabrics with liquid peroxygen bleach-containing compositions.

The compositions herein may also be used in a "soaking mode" where a composition, as defined herein, is first diluted in an aqueous bath and the fabrics are immersed and soaked in the bath, before they are rinsed, or in a "through the wash mode", where a composition, as defined herein, is added on top of a wash liquor formed by dissolution or dispersion of a typical laundry detergent. It is also essential in both cases, that the fabrics be rinsed after they have been contacted with said composition, before said composition has completely dried off.

Depending on the end-use envisioned, the compositions herein can be packaged in a variety of containers including conventional bottles, bottles equipped with roll-on, sponge, brusher or sprayers.

The invention is further illustrated by the following examples.

EXAMPLES

Following compositions were made by mixing the listed ingredients in the listed proportions (weight % unless otherwise specified).

| Compositions | I | II | III | IV | V | VI | VII | VIII |
|---|---|---|---|---|---|---|---|---|
| Dobanol ® 45-7 | 1.6 | 2.0 | 1.6 | 1.6 | 1.6 | 1.6 | 2.6 | 2.6 |
| Dobanol ® 23-3 | 2.0 | 2.0 | 2.0 | 2.0 | 2.0 | 2.0 | 1.0 | 1.0 |
| Lauryl Betaine | — | — | 2.4 | 2.4 | 2.4 | 2.4 | 2.4 | 2.4 |
| Mirataine H2C-HA ® | 5.0 | 2.4 | — | — | — | — | — | — |
| $H_2O_2$ | 7.0 | 6.0 | 6.0 | 6.0 | 6.0 | 6.0 | 6.0 | 6.0 |
| TPAB | 1.0 | 0.75 | 0.5 | — | — | — | — | — |
| DPGBE | 0.5 | — | — | 1.0 | 0.75 | — | — | — |
| DEGBE | — | — | — | — | — | 1.0 | 0.5 | — |
| Benzilic alcohol | — | — | — | — | — | — | — | 0.5 |
| HEDP | 0.16 | — | 0.16 | 0.16 | — | 0.16 | 0.16 | 0.16 |
| DTPMP | — | 0.18 | — | — | 0.18 | — | — | — |

-continued

| Compositions | I | II | III | IV | V | VI | VII | VIII |
|---|---|---|---|---|---|---|---|---|
| Propyl gallate | 0.1 | 0.1 | 0.1 | 0.1 | 0.3 | 0.1 | 0.1 | 0.1 |
| Citric acid | 0.05 | 0.05 | 0.05 | 0.05 | 0.05 | 0.05 | 0.05 | 0.05 |
| Water and minors | | | | up to 100% | | | | |
| H2SO4 up to pH 4 or 5 | | | | | | | | |
| Initial Viscosity in cps | 10 | 25 | 33 | 38 | 47 | 37 | 30 | 42 |

TPAB is Tetra Pentyl Ammonium Bromide.
DPGBE is Di Propylene Glycol Butyl Ether.
DEGBE is Di Ethylene Glycol Butyl Ether.
HEDP is 1-hydroxy-ethane diphosphonate.
DTPMP is diethylene triamine penta methylene phosphonate.
Mirataine H2C-Ha ® is Lauryl-immino-dipropionate.
Dobanol ® 23-3 is a C12—C13 E03 nonionic surfactant commercially available from SHELL.
Dobanol ® 45-7 is a C14—C15 E07 nonionic surfactant commercially available from SHELL.
Initial viscosity it is meant herein the viscosity of the product freshly made measured by using a Brookfield Digital Viscometer Model DV-II with spindle number 2 at 20° C.

TPAB is Tetra Pentyl Ammonium Bromide.

DPGBE is Di Propylen Glycol Butyl Ether.

DEGBE is Di Ethylen Glycol Butyl Ether.

HEDP is 1-hydroxy-ethane diphosphonate.

DTPMP is diethylene triamine penta methylene phosphonate.

Mirataine H2C-HA® is Lauryl-immino-dipropionate.

Dobanol® 23-3 is a C12–C13 EO3 nonionic surfactant commercially available from SHELL.

Dobanol® 45-7 is a C14–C15 EO7 nonionic surfactant commercially available from SHELL.

Initial viscosity it is meant herein the viscosity of the product freshly made measured by using a Brookfield Digital Viscometer Model DV-III with spindle number 2 at 20° C.

HEDP is 1-hydroxy-ethane diphosphonate.

DTPMP is diethylene triamine penta methylene phosphonate.

BHT is di-tert-butyl hydroxy toluene

Salt-free Betaine* is Lauryl di-methyl betaine containing 0.3% by weight of sodium chloride. This betaine is obtained by purification from commercially available Lauryl di-methyl betaine GENAGEN LAB® (Hoechst) (which contains 7.5% by weight of sodium chloride).

Compositions I to XVI when used to pretreat soiled fabrics exhibit excellent overall stain removal performance especially on greasy stains like lipstick, make-up, olive oil, mayonnaise, sebum and the like, and improved bleaching performance.

In the pretreatment mode, any of the compositions I to XVI is applied neat on the stained portion of a fabric and left to act thereon for 5 minutes. Then the fabric is washed with a conventional detergent and rinsed.

| Compositions | IX | X | XI | XII | XIII | XIV | XV | XVI |
|---|---|---|---|---|---|---|---|---|
| Dobanol ® 91-10 | — | — | — | 1.6 | — | — | 1.6 | — |
| Dobanol ® 45-7 | — | 2.0 | 1.6 | — | 2.6 | 1.6 | — | 2.0 |
| Dobanol ® 23-3 | — | — | 2.0 | 2.0 | 1.0 | 2.0 | 2.0 | — |
| Salt-free Betaine* | 5.0 | 2.4 | 2.4 | 2.4 | 2.4 | 5.0 | 5.0 | 5.0 |
| $H_2O_2$ | 7.0 | 7.0 | 6.0 | 7.0 | 5.8 | 7.0 | 7.0 | 7.0 |
| HEDP | 0.16 | — | 0.16 | — | 0.16 | 0.16 | 0.16 | 0.16 |
| DTPMP | — | 0.18 | — | 0.18 | — | — | — | — |
| Propylgallate | 0.1 | 0.1 | — | — | — | 0.1 | 0.1 | 0.1 |
| BHT | — | — | 0.1 | 0.1 | 0.1 | — | — | — |
| TPAB | 1.0 | 0.75 | 0.5 | — | — | — | — | — |
| DPGBE | 0.5 | — | — | 1.0 | 0.75 | — | — | — |
| DEGBE | — | — | — | — | — | 1.0 | 0.5 | — |
| Benzilic alcohol | — | — | — | — | — | — | — | 0.5 |
| Citric acid | 0.05 | 0.05 | 0.50 | 0.05 | 0.50 | 0.05 | 0.05 | 0.05 |
| Water and minors | | | | up to 100% | | | | |
| H2SO4 up to pH 4 or 5 | | | | | | | | |
| Initial Viscosity in cps | 10 | 25 | 3 | 38 | 47 | 37 | 30 | 42 |

HEDP is 1-hydroxy-ethane diphosphonate.
DTPMP is diethylene triamine penta methylene phosphonate.
BHT is di-tert-butyl hydroxy toluene
Salt-free Betaine* is Lauryl di-methyl betaine containing 0.3% by weight of sodium chloride. This betaine is obtained by purification from commercially available Lauryl di-methyl betaine GENAGEN LAB ® (Hoechst)(which contains 7.5% by weight of sodium chloride).

What is claimed is:

1. A aqueous liquid bleaching composition comprising:

a) from 0.0% to 20% by weight, of a peroxygen bleach;

b) from 0.001% to 20% by weight, of a zwitterionic betaine surfactant and from 0.001% to 30% by weight, of an ethoxylated nonionic surfactant;

c) from 0.001% to 20% by weight, of a viscosity controlling agent selected from the group consisting of i. $C_3$–$C_6$ alkyl ammonium salts;

ii. a glycol having the formula $R_1$—O—$(C_xH_{2x})_n$—$R_2$, wherein $R_1$ is $C_1$–$C_5$ saturated or unsaturated, substituted or unsubstituted alkyl; $R_2$ is hydrogen, $C_1$–$C_5$ saturated or unsaturated, substituted or unsubstituted alkyl, and mixtures thereof, x has a value from 2 to 4; n has a value from 1 to 5;

iii. an alcohol having the formula $R_a$—OH wherein $R_a$ is $C_3$–$C_8$ saturated or unsaturated, substituted or unsubstituted alkyl;

iv. an alcohol having the formula $R_b$—OH wherein $R_b$ is $C_5$–$C_{15}$ alkyl substituted or non-alkyl substituted aryl; and v. mixtures thereof; and d) the balance carrier and adjunct ingredients;

wherein said composition has a viscosity of from cps to 100 cps when measured with a Brookfield viscometer with spindle 2, at 30 rpm and 20° C.

2. A composition according to claim 1 further comprising from 0.01% to 15% by weight, of a nonionic surfactant having the formula:

$$RO—(C_2H_4O)_nH$$

wherein R is $C_6$–$C_{22}$ alkyl, $C_6$–$C_{28}$ alkyl benzene, and mixtures thereof; n is from to 20.

3. A composition according to claim 2 comprising from 0.5% to 10% by weight, of said surfactant.

4. A composition according to claim 3 comprising from 1% to 6% by weight, of said surfactant.

5. A composition according to claim 1 wherein said zwitterionic betaine surfactant has the formula:

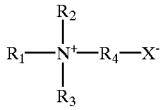

wherein $R_1$ has the formula:

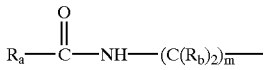

$R_a$ is $C_8$–$C_{20}$ saturated or unsaturated aliphatic, $C_8$–$C_{20}$ substituted or unsubstituted aliphatic, $C_8$–$C_{20}$ substituted or unsubstituted aromatic; and mixtures thereof; $R_b$ is hydrogen, hydroxyl, or mixtures thereof; m is from 1 to 4; $R_2$ and $R_3$ are each independently hydrogen, $C_1$–$C_6$ alkyl, $C_1$–$C_6$ substituted alkyl, $C_1$–$C_6$ hydroxy alkyl, $C_1$–$C_6$ sulfonate, and mixtures thereof; or $R_2$ and $R_3$ can be taken together to form a ring which includes the N atom; $R_4$ is $C_1$–$C_{10}$ alkylene, $C_1$–$C_{10}$ hydroxy alkylene, $C_1$–$C_{10}$ polyalkyleneoxy, and mixtures thereof; X is carboxylate, sulfonate, and mixtures thereof.

6. A composition according to claim 5 wherein said zwitterionic betaine surfactant comprises less than 3% by weight, of salt.

7. A composition according to claim 6 wherein said surfactant comprises less than 2% by weight, of salt.

8. A composition according to claim 7 wherein said surfactant comprises less than 1% by weight, of salt.

9. A composition according to claim 8 wherein said surfactant comprises from 0.01% to 0.5% by weight, of salt.

10. A composition according to claim 5 comprising from 0.5% to 8% by weight, of said zwitterionic betaine surfactant.

11. A composition according to claim 10 comprising from 1% to 5% by weight, of said zwitterionic betaine surfactant.

12. A composition according to claim 1 wherein said composition comprises from 1% to 15% by weight, of said peroxygen bleach.

13. A composition according to claim 12 wherein said composition comprises from 2% to 10% by weight, of said peroxygen bleach.

14. A composition according to claim 1 wherein said peroxygen bleach is hydrogen peroxide or a source of hydrogen peroxide selected from the group consisting of percarbonates, persilicates, persulphates, peroxyacids, hydroperoxides, diacyl peroxides, and mixtures thereof.

15. A composition according to claim 14 wherein said hydroperoxides are selected from the group consisting of tert-butyl hydroperoxide, cumyl hydroperoxide, 2,4,4-trimethylpentyl-2-hydroperoxide, di-isopropylbenzene monohydroperoxide, tert-amyl hydroperoxide, and 2,5-dimethyl hexane-2,5-dihydorperoxide.

16. A composition according to claim 14 wherein said diacyl peroxide is selected from the group consisting of dilauroyl peroxide, didecanoyl peroxide, dimyristoyl peroxide, and mixtures thereof.

17. A composition according to claim 1 wherein said viscosity controlling agent is tetra pentyl ammonium bromide, tetra butyl ammonium bromide, diethylene glycol butyl ether, diethylene glycol methyl butyl ether, dipropylene glycol butyl ether, dipropylene glycol methyl butyl ether, butanol, isobutanol, pentanol, isopentilic alcohol, benzyl alcohol, and mixtures thereof.

18. A composition according to claim 1 comprising from 0.001% to 10% by weight, of said viscosity controlling agent.

19. A composition according to claim 18 comprising from 0.05% to 5% by weight, of said viscosity controlling agent.

* * * * *

UNITED STATES PATENT AND TRADEMARK OFFICE

CERTIFICATE OF CORRECTION

PATENT NO. : 6,448,214 B1
DATED : September 10, 2002
INVENTOR(S) : Valerio Del Duca It is certified that error appears in the above-identified patent and that said Letters Patent is hereby corrected as shown below:

Column 20,
Line 25, claim 13 should read, "A composition according to claim 1. . ."

Signed and Sealed this

Eighth Day of April, 2003

JAMES E. ROGAN
*Director of the United States Patent and Trademark Office*